United States Patent [19]

Van Holten

[11] 4,044,486

[45] Aug. 30, 1977

[54] GUN SIGHT MOUNTING

[76] Inventor: James Wilbur Van Holten, Rte. 5, Columbia City, Ind. 46725

[21] Appl. No.: 659,992

[22] Filed: Feb. 23, 1976

[51] Int. Cl.[2] ..... F41G 1/38

[52] U.S. Cl. ..... 42/1 ST; 33/250

[58] Field of Search ..... 42/1 ST; 33/245, 250

[56] References Cited

U.S. PATENT DOCUMENTS

| | | | |
|---|---|---|---|
| 2,407,977 | 9/1946 | English | 33/250 |
| 2,545,419 | 3/1951 | Williams | 42/1 ST |
| 2,803,907 | 8/1957 | Weaver | 42/1 ST |
| 3,834,052 | 9/1974 | Steck | 42/1 ST |
| 3,835,565 | 9/1974 | Weast | 42/1 ST |

*Primary Examiner*—Charles T. Jordan

[57] ABSTRACT

An improved mounting for gun sights consists of a mounting bracket which can be mounted on already existing holes for pressed pins of shoulder guns. The mounting bracket is sufficiently rigid so that it can receive and have supported thereon sights, such as telescopic sights, and they are held immovable thereafter. The mounting bracket includes a track which is parallel with the bore of the gun and is spaced slightly above the barrel. The track is secured to the bracket and a sight, such as a telescopic sight, and is replaceably clamped to the track. The mounting bracket is easily removed from the firearm receiver. The sight on the mounting bracket is selectively removeable and replaceable.

5 Claims, 4 Drawing Figures

GUN SIGHT MOUNTING

BACKGROUND OF THE INVENTION

It is desired to utilize various telescopic sights with shoulder weapons, such as shotguns, rifles, and the like. Frequently, the method for mounting these sights necessitates drilling and tapping the gun with openings. Many gun owners are naturally reluctant to deface their weapons by drilling them to obtain a mounting and, consequently, the choice of gun owner is either drill openings for mounting telescopic sights and run the risk of defacing the gun or accept the limitations of mounting techniques for these various sights, such as telescopic sights.

The present invention proposes that the gun be equipped with a new mounting type bracket which can utilize existing holes with the bracket being mounted on bolts, thereby obviating any additional drilling or provision of new mounting structure. The present invention proposes that the mounting bracket be secured to the gun by existing structure.

The bracket includes a mounting portion extending alongside the gun and a transverse section which is located above, i.e. spaced slightly above the barrel and adapted to provide support for a telescopic sight which is held rigidly, but replaceably, within a track at the upper surface of the mounting flange surmounting the barrel.

OBJECTS OF THE INVENTION

It is an object of the present invention to provide a new and improved mounting for gun sights which is adapted for utilization with the existing hole mountings already provided on the gun so that such mounting bracket can be fastened to the gun by existing structure, obviating the need for additional drilling or other work on the gun.

It is a further object of the present invention to provide a gun sight mounting which is relatively rigid so that it can replaceably hold and clamp in place telescopic sights and the like in operative position upon the gun, such mounting being in the form of a bracket which is rigid for accurate mounting, yet economical to produce and install on the gun.

Other objects and features of the present invention will become apparent from a consideration of the following description which proceeds with reference to the accompanying drawings wherein an example embodiment is selected by way of illustration and not by limitation.

DRAWINGS

DETAILED DESCRIPTION OF THE INVENTION

Figure 1:
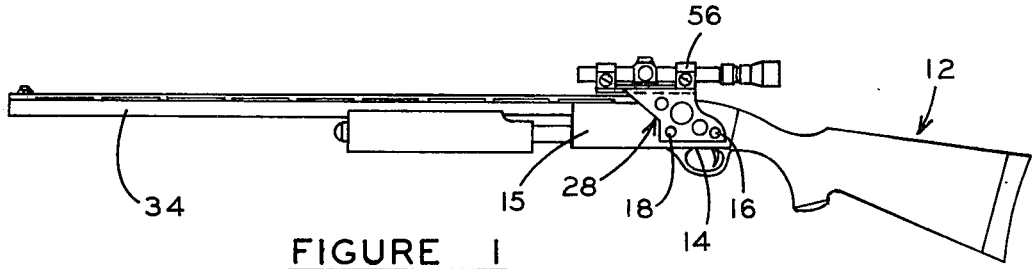
FIG. 1 is a side elevation view of a shotgun and the mounting bracket installed thereon, viewed at the left-hand side of the weapon.
Figure 2:
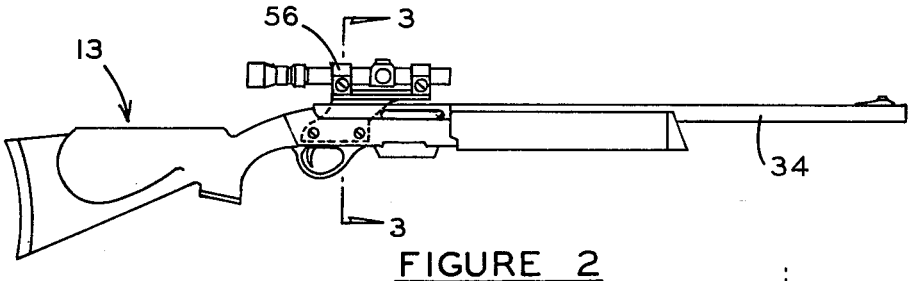
FIG. 2 is a side elevation view of a rifle also having the invention installed thereon as viewed at the right-hand side of the weapon.
Figure 3:
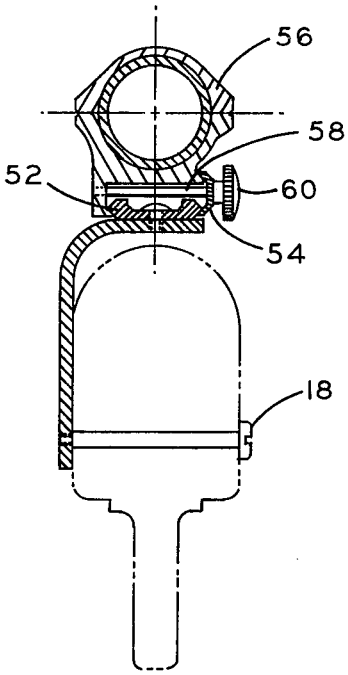
FIG. 3 is a section view taken on line 3—3.
Figure 4:
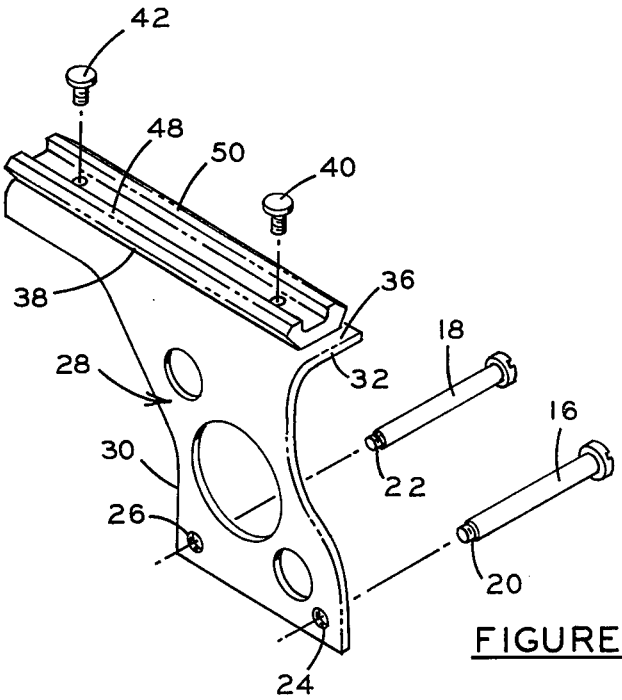
FIG. 4 is an isometric view of the bracket and mounting bolts already provided in the receiver and the mounting screws securing the track onto the upper flange of the bracket.

Referring now to the drawings, a mounting bracket designated generally by reference numeral 28 is mounted on shoulder gun 12 indicated as a shotgun in FIG. 1 and a rifle 13 in FIG. 2.

As indicated in FIG. 1, the trigger housing 14 is secured to the receiver 15 by means of two bolts 16 and 18.

The two bolts 16, 18 pass through the housing and their threaded ends 20, 22 are screwed into companion openings 24, 26 of mounting bracket 28.

After ends 20, 22 of the bolts are screwed into openings 24, 26 bracket 28 becomes firmly clamped to the receiver of the gun. Mounting bracket 28 consists of a side flange 30 and transverse flange 32 which extends parallel to the barrel 34. At upper surface 36 of flange 32 is a track 38 secured by screws 40, 42 to flange 32. Track 38 has two wedge surfaces 48, 50 at the undersurface of which are received clamping wedges 52, 54 of a telescopic sight 56. Telescopic sight 56 is clamped onto the track by means of a threaded stem 58 which is turned by a knurled knob 60 causing the sight 56 to become firmly secured to the track.

The mounting is such that any preferred sight can be readily coupled and decoupled from the track 38.

Once the sight is mounted, it is rigidly held in place and is parallel to the axis of the barrel. The accurate placement of the sight and its rigid mounting relatively to the gun, once it is in place precludes accidental movement and, therefore, contributes to the accuracy of mounting, sighting and firing.

It is an important feature of the present invention that mounting bracket 28 is securable to the gun without any additional drilling or other fastening and, consequently, it is impossible to take a conventional rifle or shotgun of the Remington type and, without further requirement, simply utilize the two holes which already are a part of the gun and are found as the existing means for clamping the mounting bracket to the receiver.

If desired, existing bolts can also be removed and other and different bolts inserted in their place to provide additional length needed for mounting the bracket 28.

Although the present invention has been illustrated and described in connection with a few selected example embodiments, it will be understood that these are illustrative of the invention and are by no means restrictive thereof. It is reasonably to be expected that those skilled in this art can make numerous revisions and adaptations of the invention and it is intended that such revisions and adaptations would be included in the scope of the following claims.

What I claim is:

1. A shoulder gun having a receiver, two spaced mounting bolts, a trigger housing retained by said mounting bolts, a mounting bracket including two openings, one for each of said mounting bolts and adapted to be clamped to the gun by said bolts, said bracket having an upright flange portion extending alongside of the receiver, a transverse flange disposed slightly above the receiver and in parallel relationship with the receiver of said gun, means forming a track on said transverse flange and extending for virtually the entire length of said transverse flange to provide a continuously extending mounting means of variably useable length and including parallel longitudinally extending continuous wedge sections, screw means for fastening said track on to said transverse flange, and replaceable sight means including mounting means mounted on said track and movable to a preferred position along the length of said track over the length of said transverse flange covered by said track, said mounting means including a screw-clamping means for effecting a rigid mounting connection between said track and said sight means.

2. The mounting bracket in accordance with claim 1, including a curved rearward edge adjacent the receiver of the gun and proportioned to provide unimpeded sighting through the sight means.

3. The mounting bracket in accordance with claim 1 wherein said mounting bracket is a rigid metallic construction adapted to support the sight means relatively inflexibly at its mounted position above the receiver and in parallel relationship therewith.

4. The mounting bracket in accordance with claim 1 in which said mounting bracket has a posterior edge inclined in a direction toward the upper part of the receiver and extending parallel thereto to provide rigid reinforcement for the transverse flange along the entire length thereof.

5. Mounting bracket in accordance with claim 1 wherein said bracket includes a curved portion connecting said upright flange portion to said transverse flange and extending the entire length of said transverse flange, said upright flange portion having forwardly inclined front and rear edges providing rigid reinforcement for said transverse flange.

* * * * *